US005676482A

United States Patent [19]

Hawkins

[11] Patent Number: 5,676,482

[45] Date of Patent: Oct. 14, 1997

[54] MACHINE-WASHABLE ALBUM WITH REMOVABLY AFFIXING MEANS

[76] Inventor: Cynthia Sidwell Hawkins, 3518 Kensington, Amarillo, Tex. 79121

[21] Appl. No.: 667,501

[22] Filed: Jun. 21, 1996

[51] Int. Cl.[6] ..... B42F 13/00

[52] U.S. Cl. ..... 402/79; 281/38; 281/31

[58] Field of Search ..... 281/38, 15.1, 21.1, 281/31, 29, 51; 402/79; 206/472, 475; 446/71

[56] References Cited

U.S. PATENT DOCUMENTS

| | | | |
|---|---|---|---|
| D. 264,602 | 5/1982 | Plutsky . | |
| 4,280,241 | 7/1981 | Pfaff | 281/29 X |
| 4,447,973 | 5/1984 | Wihlke | 281/38 X |
| 4,832,648 | 5/1989 | Theobald et al. | 281/29 X |
| 5,025,581 | 6/1991 | Polzin . | |
| 5,213,507 | 5/1993 | Ozrovitz . | |
| 5,266,034 | 11/1993 | Mitz . | |
| 5,358,407 | 10/1994 | Lainer . | |
| 5,370,419 | 12/1994 | Takayama | 281/38 X |
| 5,383,684 | 1/1995 | Smath | 281/29 |
| 5,387,107 | 2/1995 | Gunter et al. . | |
| 5,426,876 | 6/1995 | Jagoe et al. . | |
| 5,464,253 | 11/1995 | Farrell | 281/38 |
| 5,472,364 | 12/1995 | Castleman | 281/29 X |

*Primary Examiner*—Willmon Fridie, Jr.

*Attorney, Agent, or Firm*—Robert D. McCutcheon, Esq.; Winstead Sechrest & Minick P.C.

[57] ABSTRACT

An album for displaying photographs, drawings, objects and the like includes a front cover, a back cover, and a plurality of pages disposed therebetween. Each of the pages includes an attachment means whereby a photograph, drawing or object may be removably attached or affixed to the page. The album substantially comprises machine-washable material with the front and back covers and interior pages sewn together to provide a washable album. Filler material is provided within each of the pages to provide a thicker page and a soft durable album.

20 Claims, 3 Drawing Sheets

MACHINE-WASHABLE ALBUM WITH REMOVABLY AFFIXING MEANS

TECHNICAL FIELD OF THE INVENTION

The present invention relates to a fabric album and more particularly to a machine-washable album with a means for removably attaching photographs, pictures, labels, objects, and the like.

BACKGROUND OF THE INVENTION

Albums, such as photograph albums and scrapbooks, are commonly used to display photos, drawings and clippings. These albums are designed to store a large number of photographs in an orderly manner. Typically, such albums are bound in a cover constructed of sturdy materials that will not tear or be easily disengaged from the album. The album cover is also designed to protect the materials exhibited on the interior pages of the album.

Typically numerous pages are bound in an album cover in such a way that the user can view the materials on the interior pages by leafrag through the album. Thus the album user may view the enclosed photographs or drawings by paging through the album as if the user were reading a book.

Once placed in the album, the photographs and drawings are not easily removed, and, in some cases, cannot be removed without damaging the photograph album, the photographs or drawings, or without replacing the photograph holders or protective covers. Further, frequent removal and attachment of the photographs or drawings (i.e., changing the photographs, drawings) is tedious and time-consuming, and difficult to perform for those with reduced motor skills.

Typically, the albums are made of hard, inflexible materials with a number of thin pages and are relatively heavy. As such, individuals who desire their own personal photo album, such as children or the elderly, but who lack sufficient strength to carry or move the album, have difficulty with these heavy and inflexible albums. The sturdy, inflexible materials of which the albums are constructed may cause injury to a child if the child were to fall while walking or running with the album, or may cause injury if the album was thrown or otherwise used as an object to be thrown during play. In addition, the thin pages of those albums are difficult to turn for anyone who lacks basic motor coordination.

SUMMARY OF THE INVENTION

The problems discussed above have been solved in the present invention, which provides an album bound with soft, flexible materials that can be easily manipulated by a child or any other individual with limited small motor coordination.

One embodiment of the present invention is an album for containing and displaying an object. The album includes a front cover substantially comprising machine-washable material, a back cover substantially comprising machine-washable material, and a plurality of pages disposed between the front cover and the back cover. Each page of the album has a first surface and a second surface (both surfaces substantially comprised of a machine-washable material). The album also includes a means, coupled to one of the pages, for removably attaching the object to be displayed to the page having the attaching means coupled thereto.

Another embodiment of the present invention is an album for containing and displaying one or more objects. The album includes a front cover substantially comprising machine-washable material, a back cover substantially comprising machine-washable material, and a plurality of pages disposed between the front cover and the back cover. Each page of the album has a first surface and a second surface substantially comprised of a machine-washable material and including a filler material. The album also includes a plurality of means for removably attaching objects to the pages. Each page of the album has an attaching means coupled to either the first surface or the second surface of the page.

The invention further includes a method of containing and displaying one or more objects within an album. The method includes the steps of: providing a front cover substantially comprising machine-washable material; providing a back cover substantially comprising machine-washable material; disposing a plurality of pages between the front cover and the back cover, each page having a first surface and a second surface and substantially comprising machine-washable material and including a filler material; and removably attaching an object to a surface of one of the plurality of pages using an attachment means coupled to the surface of the one of the plurality of pages.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following description taken in conjunction with the accompanying drawings wherein.

DETAILED DESCRIPTION OF THE INVENTION

Figure 1:
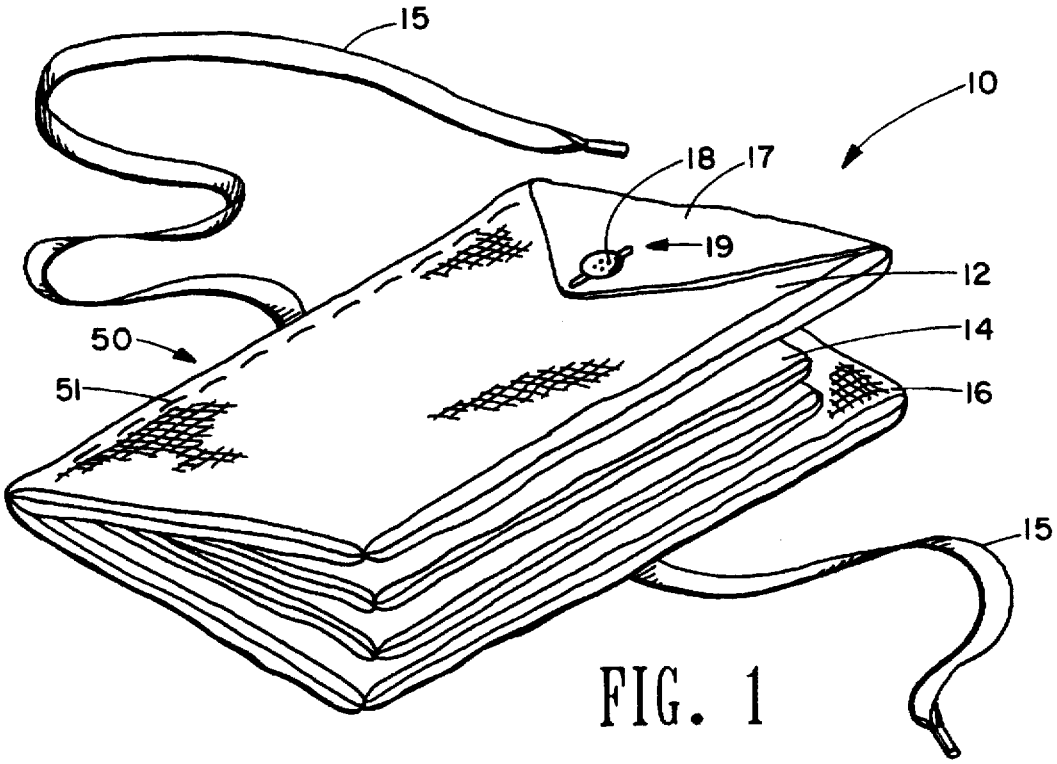
FIG. 1 shows a perspective view of an album in accordance with the present invention.

With reference to the drawings, like reference characters designate like or similar parts throughout the drawings.

Figure 2:
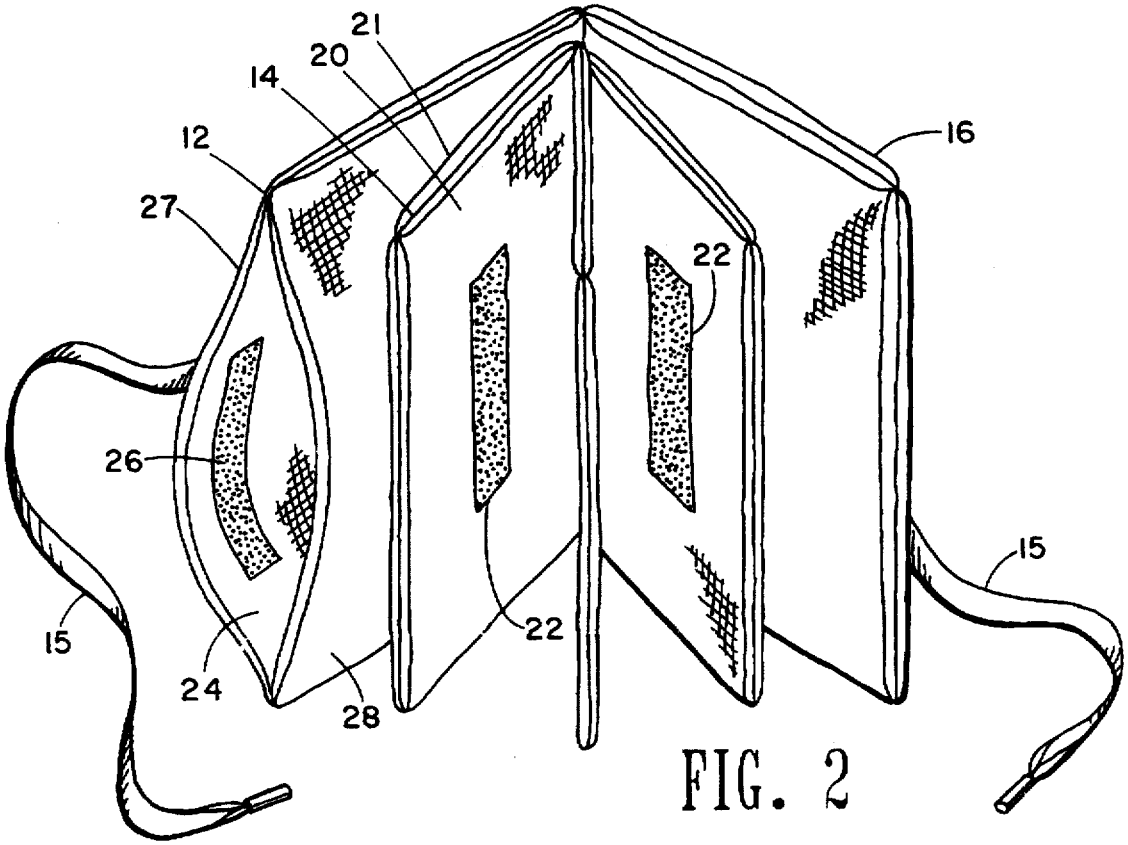
FIG. 2 illustrates the album shown in FIG. 1 as partially opened.

Now referring to FIGS. 1 and 2, there is shown an album 10 in accordance with the present invention. The album 10 includes a front cover 12, a back cover 16, and a plurality of pages 14 pivotally disposed between the front cover 12 and the back cover 16. The album 10 is typically of a rectangular shape and can be small (for an individual's use) or large (for classroom usage). The pages 14 each have a first surface 20 and a second surface 21. An attachment means 22 is coupled to the first surface 20, or the second surface 21, or both. The attachment means 22 allows removable fixation or attachment of photographs, pictures, drawings, labels, and/or objects, and the like, to the page 14. The attachment means 22 is coupled to the surface 20, 21 by any means known to those skilled in the art, such as by being sewn, glued, snapped, riveted, and the like, to the fabric of the page 14. The attachment means 22 may include any structures or means to couple a photograph, picture, drawing, label, object, and the like, to the page 14. In one embodiment, the attachment means 22 comprises a Velcro strip. As will be appreciated, a corresponding Velcro strip is placed on the photograph, picture, drawing, label, object, etc. and is used for coupling to the page 14.

The front cover 12, the back cover 16, and the pages 14 are constructed substantially of a machine-washable material or fabric. The machine-washable material may include cotton, dacron, polyester, rayon, polyester-cotton or dacron-polyester combinations, nylon, and the like, or any other type of machine-washable fabric. In one embodiment (see FIG. 4B), the pages 14 include a filler material 46 inserted within the pages 14 to provide the pages 14 with more substance and thickness. The fabric construction of the album 10 makes the album soft and flexible so that it will reduce the likelihood of injury. As will be appreciated, the front cover 12 and the back cover 16 may also include filler material 46 disposed therein. The filler material 46 may include batting (comprising any type of machine-washable fabric or material), foam fillers, and the like. The pages 14 with the filler material 46 disposed therein both increase the thickness and softness of the pages 14. The increased thickness allow the pages 14 to be easily grasped and mined by small children or adults with limited motor coordination.

Now referring to FIG. 2, the front cover 12 includes a pocket 24 for storing objects, laminated cards, felt numbers and letters, pictures, a water-based pen, or the like. In one embodiment shown in FIG. 2, the pocket 24 is inserted into the front cover 12 (see FIG. 2). The pocket 24 is formed integrally with the front cover 12 or is separately coupled (via sewing, glue, etc.) to the interior side of an exterior piece of fabric 27 of the front cover 12 and to the interior side of an interior piece of fabric 28 of the front cover 12. As will be appreciated, the filler material 46 may be placed within the front cover 12 and disposed between the exterior piece of fabric 27 of the front cover 12 and a wall of the pocket 24 and between the interior piece of fabric 28 of the front cover 12. As will be appreciated, the pocket 24 may be optional. Although pocket 24 is shown incorporated within (or part of) the front cover 12, a similar or identical pocket may also be incorporated into the album as part of a page 14, or within the back cover 16.

In one embodiment illustrated in FIG. 2, the pocket 24 is secured in a closed position by a closing means 26. The closing means, as shown in FIG. 2, is a hook and loop mechanism, commercially known as Velcro, to hold the two sides of pocket 24 together (see FIG. 2), thereby closing the pocket 24. It will be understood by a person skilled in the art that various types of structures may be utilized to perform the function of the closing means 26. In another embodiment shown in FIG. 1, the pocket 24 includes a flap 17. The flap 17 may be an extension of the interior piece of fabric 28 of the front cover 12 (see FIG. 1). A coupling means 19 is provided to couple the flap 17 to the front cover 12, thus closing the pocket 24. The coupling means 19 includes a button 18 for fastening to the flap 17. The Flap 17 is removably adhered via coupling means 19 to the front cover 12. As will be appreciated, the coupling means 19 may include any type of structure to perform the desired function of coupling, such as a snap, Velcro, and the like. Securing the pocket 24 in a closed position allows the user of the album 10 to carry a variety of small items in the pocket 24 without having to worry about the items falling out while the album is being transported, or the pictures and other materials in the album are being shown to another person.

With continued reference to FIGS. 1 and 2, the album 10 may be transported and shown to a number of different people. Thus, it is important to the user that the photographs, drawings, etc. disposed within the album be protected and not allowed to fall off or be inadvertently removed. One way of protecting the contents of the album 10 is to secure the front cover 12, the pages 14, and the back cover 16 in a closed position using a cloth tie 15. The cloth tie 15 is similar to an oversized shoelace. The cloth tie 15 is easily tied to close the album 10 and untied to open the album 10. The effective length of the cloth tie 15 is adjustable to fit around the album 10 when it is filled with a number of materials or when it is empty by varying the tightness to which the cloth tie 15 is tied. It will be understood that the front cover 12, pages 14, and back cover 16 may be secured in a closed position by a variety of means. In another embodiment, illustrated in FIG. 3, the album 10 is closed is with a flap 35 attached to the back cover 16 and adapted to reversibly attach to the front cover 12 using a snap, Velcro, or other means known in the art. The flap 35 may be adjustable in length if, for example, the flap 35 is made of an elastic band.

Figure 3:
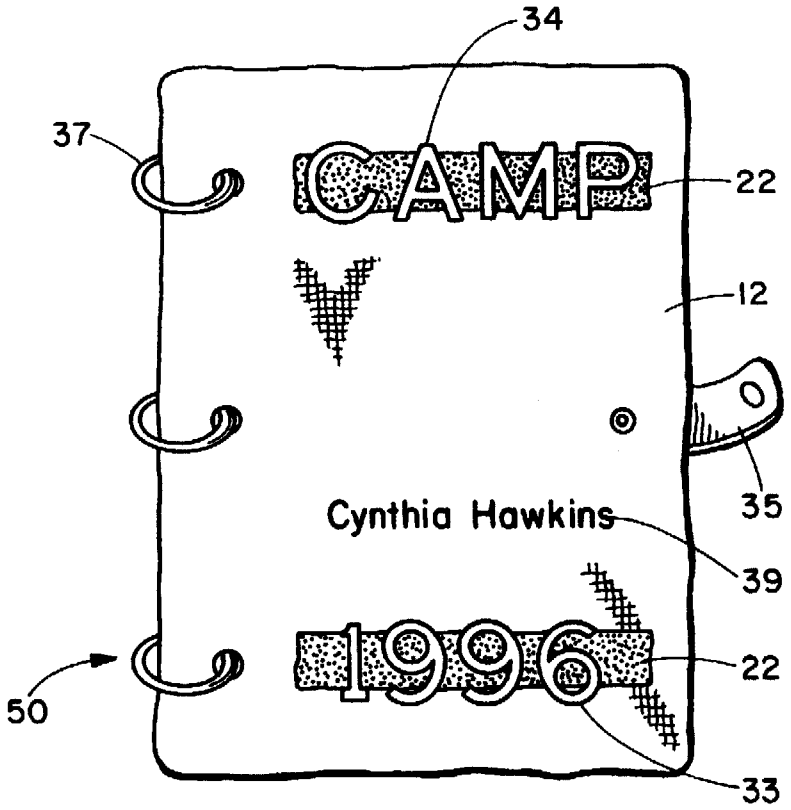
FIG. 3 shows a top view of an alternative embodiment of the present invention.

Referring to FIG. 3, there is shown the front cover 12 of the album 10. The front cover 12 may include features to personalize the album 10 to the owner/user. For instance, the front cover 12 includes the attachment means 22 that interact with felt numbers 33 and letters 34 to designate the nature of the contents of the album 10. The user may also have the front cover 12 embroidered with the user's name 39.

Generally, the front cover 12, the pages 14, and the back cover 16 are bound together such that pages 14 are pivotally disposed between the front cover 12 and the back cover 16. In one embodiment of album 10, the component parts of album 10 are bound together by sewing the parts together to form a binding 50. This can be done by sewing a single piece of fabric ( where the fabric wraps around the entire album 10 and forms the exterior surfaces of both the front cover 12 and the back cover 16) to interior pieces of fabric (where the interior pieces form the interior surface of both the front cover 12 and the back cover 16) and pages 14 to form a seam 51, as illustrated in FIG. 1. Having all of the component parts of album 10 sewn together as a single unit allows the album 10 to be washed without disassembling and reassembling its component parts.

FIG. 3 illustrates an alternative embodiment of the binding 50 of the album 10. The front cover 12, the back cover 16 and the pages 14 are secured with an expandable binding mechanism 37. The binding mechanism 37 includes binder rings inserted through a plurality of holes (not shown) in the front cover 12, the back cover 16, and the pages 14. The expandable binding mechanism 37 allows the addition or removal of the pages 14 whenever desired. Thus a variety of preconstructed pages 14 can be made for the user to choose from and to add to the album 10.

Figure 4A:
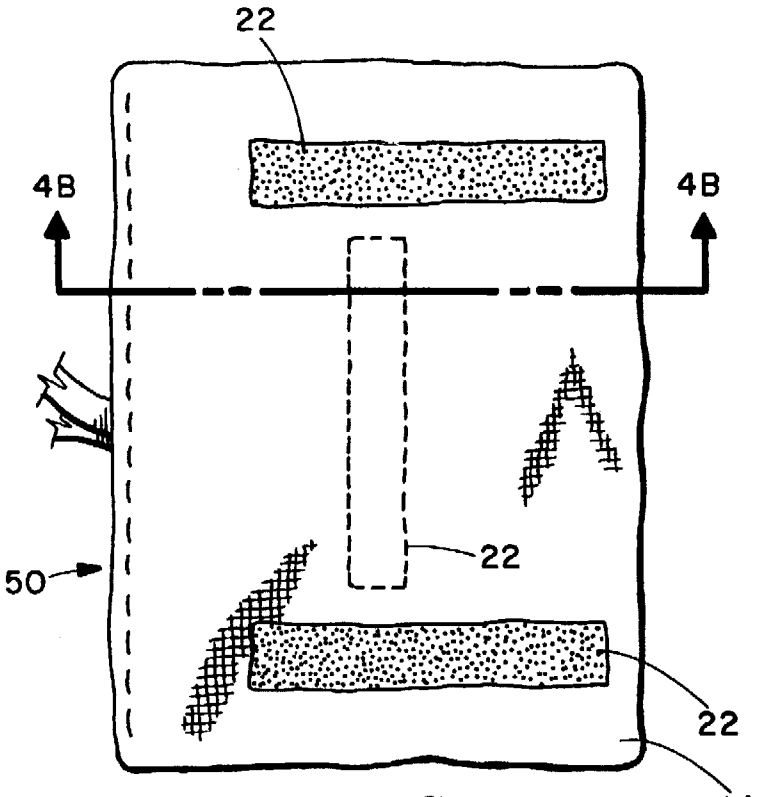
FIG. 4A shows an alternative embodiment of the page shown in FIG. 2.

Now referring to FIG. 4A, there is shown an example of the page 14 with the attachment means 22 for removably affixing photographs, drawings, labels, object, etc. to the page 14. As shown, a plurality of attachment means 22 are provided on one of the surfaces of the page 14. The attachment means 22 secures objects (such as photographs, clippings, drawings, etc.) to the page 14 and allows them to be removably and interchangeably secured to the page 14 by the readily reusable, durable, two-piece Velcro fastening tapes or strips. Typically, the attachment means 22 is comprised of one piece of Velcro or fastening tape having hooks or loops formed thereon. The attachment means 22 is sewn, glued, or otherwise coupled to the surface of page 14. Another piece of Velcro or fastening tape is attached to the back of the photographs, drawings, labels, objects, etc. As appreciated, the two pieces of Velcro or fastening tape, when in contact with each other, provide an attachment or affixation function. The pieces are joined by the application of a slight pressure, and separated by a prying or pulling movement to release one piece from the other. It will be understood that the first side 20 and the second side 21 of the page 14 may have differing numbers of attachment means 22 thereon, and in any possible number of orientations.

Figure 4B:
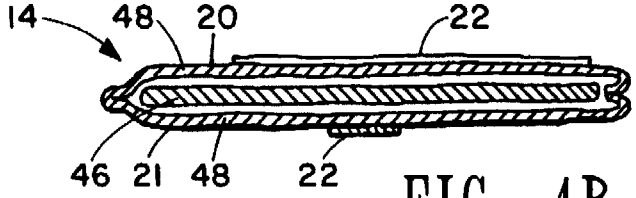
FIG. 4B shows a cross-section of the embodiment of the page shown in FIG. 4A taken along section 4B—4B of FIG. 4A.

Now referring to FIG. 4B, there is shown a cross-section of the page 14 shown in FIG. 4A taken along section 4B—4B. Two pieces of fabric 48 are joined with batting 46 disposed therebetween. The attachment means 22 (e.g., a strip or piece of Velcro) is sewn, glued, or otherwise coupled to each side of the page 14. The page 14 shown in FIG. 4A includes one attachment means 22 oriented in a vertical direction on the second surface of the page 14 and two attachment means 22 oriented in a horizontal direction on the first surface of the page 14.

Figure 5:
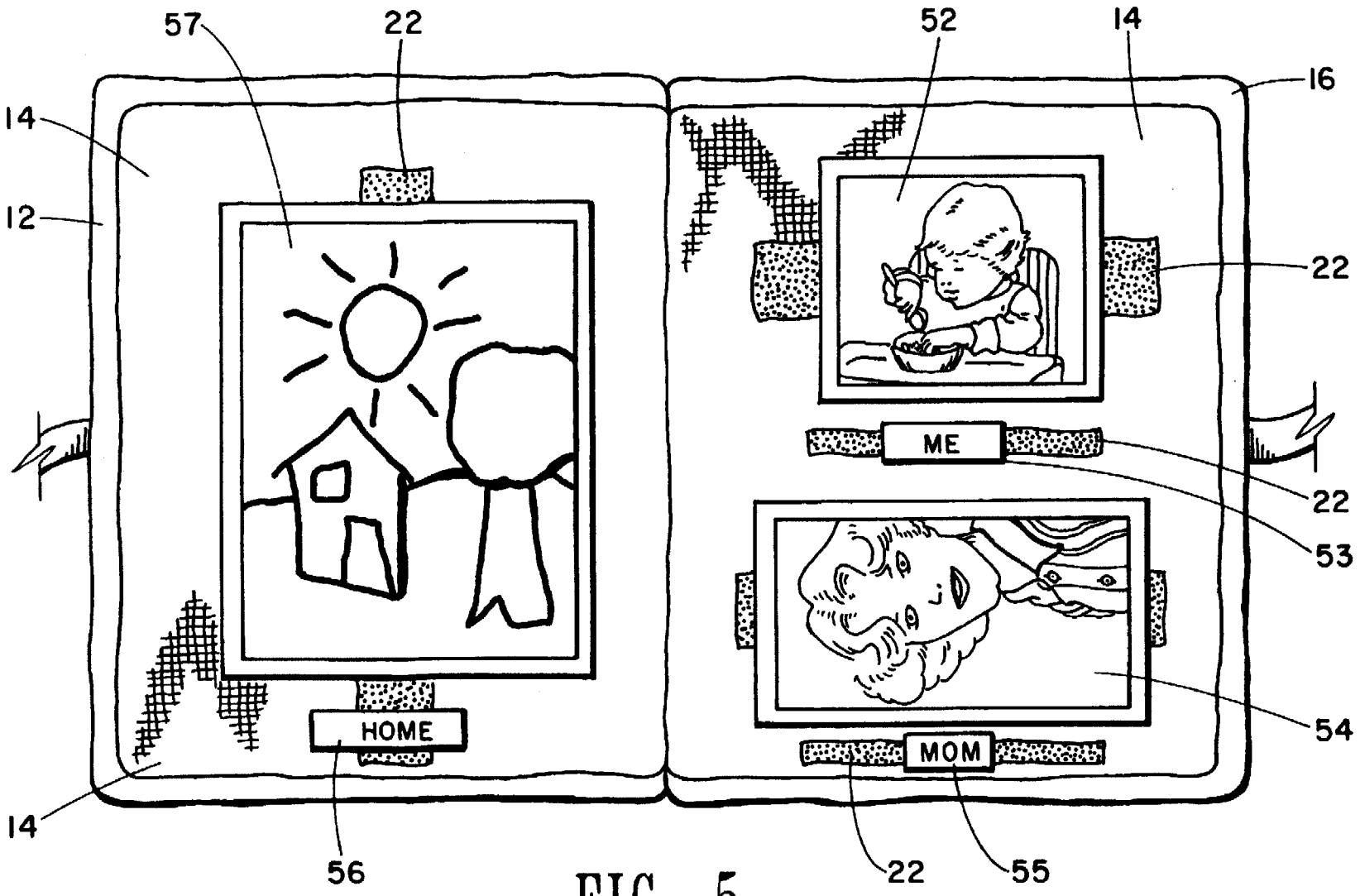
FIG. 5 shows a top view of one embodiment of the present invention when it is opened and laid flat.

Now referring to FIG. 5, there are illustrated various objects 52, 53, 54, 55, 56, 57 that may be removably and interchangeably affixed or attached to the pages 14 utilizing the attachment means 22. The page 14 on the left side of FIG. 5 illustrates a picture dram by a child onto a card 57 that has been laminated to allow drawings done with a water-based pen to be erased. Such laminated cards may be used in a variety of sizes and shapes. For example, larger cards may be used for children to draw on and smaller cards may be used for children to write labels 53, 55, 56 for photographs, drawings, pictures, objects 52, 54, 57. Photographs may be laminated to protect them from getting wet, or they may be unlaminated and have a small piece of Velcro attached directly to the back of them. Any number of permutations and combinations of pictures, labels, felt numbers and letters, photographs, and like items may be placed in the album 10.

The present invention can be used to increase a person's hand and eye coordination and recognition manipulatives by having the user recognize words on preprinted labels to match the photographs or pictures displayed. A person's application of these hand and eye coordination and recognition manipulatives help to improve thinking and solving skills, small motor coordination skills, and recognition skills of that person. This is particularly true for people that are small children or patients recovering from debilitating diseases.

While preferred embodiments of the invention have been shown and described, it will be apparent to those skilled in the art that the conception and the specific embodiments disclosed herein may be readily utilized as a basis for modifying and designing other structures for carrying out the same purpose as the present invention. It should also be realized to those skilled in the art that such equivalent constructions do not depart from the spirit and scope of the invention as set forth in the appended claims.

What is claimed is:

1. An album for containing and displaying an object, the album comprising:

a front cover substantially comprising machine-washable material;

a back cover substantially comprising machine-washable material;

a plurality of pages disposed between the front cover and the back cover, each page having a first surface and a second surface and substantially comprising machine-washable material;

means, coupled to a one of the plurality of pages, for removably attaching the object to the one of the plurality of pages; and means, coupled to the front cover, for removably attaching indicia thereon.

2. The album of claim 1 wherein each of the plurality of pages includes means for removably attaching an object to the page.

3. The album of claim 1 further comprising a pocket within one of the front cover or the back cover.

4. The album of claim 3 wherein the pocket includes means for closing the pocket.

5. The album of claim 1 wherein the plurality of pages each include a filler material.

6. The album of claim 5, wherein the front cover and the back cover include a filler material.

7. The album of claim 5 wherein each of the plurality of pages includes a first piece of fabric and a second piece of fabric with the filler material positioned therebetween, the filler material comprising batting sewn between the first piece of fabric and the second piece of fabric.

8. The album of claim 1 further comprising means for binding the front cover, the back cover and the plurality of pages, the means for binding adapted to allow the addition or subtraction of one or more pages.

9. The album of claim 1 further comprising means for securing the album in a closed position, the means for closing being openable when the album is in use.

10. The album of claim 1 wherein the means for removably attaching comprises velcro.

11. An album for containing and displaying one or more objects, the album comprising:

a front cover substantially comprising machine-washable material;

a back cover substantially comprising machine-washable material;

a plurality of pages disposed between the front cover and the back cover, each page having a first surface and a second surface and substantially comprising machine-washable material and including a filler material substantially comprising machine-washable material and disposed between the first surface and the second surface; and plurality of means, each coupled to a one of the first surface or second surface of each of the plurality of pages, for removably attaching an object to the each one of the plurality of pages, the means for removably attaching comprising substantially machine-washable material, and whereby the front cover, the back cover, the plurality of pages, and the plurality of means for removably attaching comprise substantially machine-washable material such that the album is machine washable.

12. The album of claim 11 wherein the means for removably attaching comprises velcro.

13. The album of claim 12 further comprising a pocket within one of the front cover or the back cover.

14. The album of claim 13 wherein the front cover and the back cover include a filler material for increasing the thickness and providing padding to the front cover and the back cover.

15. The album of claim 14 further comprising means for binding the front cover, the back cover and the plurality of pages, the means for binding adapted to allow the addition or subtraction of one or more pages.

16. The album of claim 15 wherein the means for binding includes at least one binder ring disposed through the front cover, the back cover and the plurality of pages to allow the addition or subtraction of one or more pages.

17. The album of claim 11 wherein the filler material comprises batting sewn between the first surface and the second surface.

18. An album for containing and displaying one or more objects, the album comprising:

a front cover substantially comprising machine-washable material;

a back cover substantially comprising machine-washable material;

a page disposed between the front cover and the back cover, the page having a first surface and a second surface and substantially comprising machine-washable material and including a filler material substantially comprising machine-washable material disposed between the first surface and the second surface; and means, coupled to a one of the first surface or second surface of the page, for removably attaching an object to the page, the means for removably attaching comprising velcro.

19. The album of claim 18 further comprising at least one binder ring disposed through the front cover, the back cover and the page to allow the addition or subtraction of one or more pages.

20. The album of claim 18 wherein the filler material comprises batting sewn between the first surface and the second surface.

* * * * *